US008033487B2

(12) United States Patent
Yamashita et al.

(10) Patent No.: US 8,033,487 B2
(45) Date of Patent: Oct. 11, 2011

(54) CRUSHER

(75) Inventors: Saiji Yamashita, Hirakata (JP); Syuji Shinagawa, Hirakata (JP); Kazunari Hanaoka, Hirakata (JP); Kiyokazu Suzuki, Hirakata (JP)

(73) Assignee: Matsui Mfg. Co., Ltd., Osaka (JP)

( * ) Notice: Subject to any disclaimer, the term of this patent is extended or adjusted under 35 U.S.C. 154(b) by 239 days.

(21) Appl. No.: 12/442,979

(22) PCT Filed: Feb. 19, 2007

(86) PCT No.: PCT/JP2007/052936

§ 371 (c)(1),
(2), (4) Date: Mar. 26, 2009

(87) PCT Pub. No.: WO2008/038420

PCT Pub. Date: Apr. 3, 2008

(65) Prior Publication Data

US 2009/0294563 A1 Dec. 3, 2009

(30) Foreign Application Priority Data

Sep. 28, 2006 (JP) ..... 2006-265016

(51) Int. Cl.

| | |
|---|---|
| ***B02C 9/04*** | (2006.01) |
| ***B02C 13/00*** | (2006.01) |
| ***B02C 17/02*** | (2006.01) |
| ***B07B 13/00*** | (2006.01) |
| ***B07C 7/00*** | (2006.01) |

(52) U.S. Cl. ..... 241/73; 241/243; 241/285.3

(58) Field of Classification Search ..... 241/73, 241/243, 189.1, 285.3

See application file for complete search history.

(56) References Cited

U.S. PATENT DOCUMENTS 4,385,732 A * 5/1983 Williams ..... 241/236
4,738,404 A 4/1988 Mitchell (Continued)

FOREIGN PATENT DOCUMENTS

CN 88 1 00480 8/1988

(Continued)

OTHER PUBLICATIONS

International Search Report for corresponding application No. PCT/JP2007/052936 completed Mar. 13, 2007.

(Continued)

*Primary Examiner* — Bena Miller

(74) *Attorney, Agent, or Firm* — Renner, Otto, Boisselle & Sklar, LLP

(57) ABSTRACT

When the rocking side wall is to be opened, the rocking side wall is rotated about a shaft body and a cutout surface comes into contact with a side surface on the upper side of a connection plate When the rocking side wall is further opened with the cutout surface in contact with the side surface on the upper side of the connection plate, the rocking side wall is rotated about the shaft body in operative association with the connection plate. In the middle of the opening motion of the rocking side wall, a rocking axis of the rocking side wall moves from the shaft body to the shaft body. When the rocking side wall is rotated about the shaft body placed closer to the outside than the shaft body, the rocking side wall is opened while being further away from rough crush blades and the crush blades, and this widen the opening between the rocking side walls.

8 Claims, 12 Drawing Sheets

U.S. PATENT DOCUMENTS

| | | | | |
|---|---|---|---|---|
| 5,482,218 | A * | 1/1996 | Ha | 241/30 |
| 5,906,322 | A * | 5/1999 | Hama | 241/152.2 |
| 5,975,443 | A * | 11/1999 | Hundt et al. | 241/27 |
| 2004/0245360 | A1 * | 12/2004 | Katsumura et al. | 241/243 |

FOREIGN PATENT DOCUMENTS

| | | |
|---|---|---|
| JP | 2004-105863 | 4/2004 |
| JP | 2004-202365 | 7/2004 |
| JP | 2005-279352 | 10/2005 |
| TW | 407527 | 10/2000 |
| TW | 417508 | 1/2001 |
| TW | 439557 | 6/2001 |

OTHER PUBLICATIONS

Taiwan Notice of Allowance for corresponding Application No. 096106665 mail Apr. 29, 2009.

* cited by examiner

CRUSHER

This application is the national phase under 35 U.S.C. §371 of PCT International Application No. PCT/JP2007-52936 which has an International filing date of Feb. 19, 2007 and designated the United States of America.

BACKGROUND

1. Technical Field

The present invention relates to a crusher which can facilitate cleaning of crush debris, reduce cleaning time and prevent crush debris from remaining in the crusher.

2. Description of Related Art

Creation of a recycling society has been of increasing importance in order to solve problems such as environmental pollution or increased industrial waste. For example, in a molding plant for producing molded articles or molded components using synthetic resin typified by plastic, unwanted parts referred to as sprue runners or defective moldings, which are generated in molding, are collected so as to enhance the resources recycling rate of resin material.

For recycling of resin material, collected sprue runners are crushed by a crusher into crush debris having a predetermined size and used as recycle resources. Such a crusher first roughly crushes sprue runners, which have been introduced from an inlet hopper, with a rough crush blade so that the sprue runners can easily be bitten by a crush blade, and then crushes the roughly crushed material with a crush blade into crush debris having a predetermined pellet shape. A single-shaft type crusher, in which a rough crush blade and a crush blade are fixed at one rotating shaft, is composed of a small number of drive components for driving the rotating shaft and has a simple structure, and therefore is utilized in a large number of establishments aiming at in-house recycle.

On the other hand, when material to be crushed is changed, it is necessary to eliminate crush debris remaining in the crusher every time the material is changed, in order to prevent mixing of different materials. It is necessary to detach the rough crush blade and the crush blade or the like for disassembly and cleaning in order to clean the inner part of the crusher, since crush debris remains at a variety of places, such as clearance of a crush blade provided with a blade edge having a complicated shape, the surrounding area of a rough crush blade, or the inner side of a rough crush blade cover for preventing discharge of material roughly crushed by the rough crush blade. Such cleaning task is difficult and requires a fair amount of time. Consequently, a crusher having a double swing structure at a pair of surfaces of a casing body for covering a rough crush blade and a crush blade has been produced in order to reduce cleaning time and facilitate the cleaning task.

FIG. 12 is a schematic side view for illustrating an essential part of a conventional crusher. The crusher has a substantially box-shaped structure. A pair of fixed side walls 52, 52 are arranged away from each other at one opposed positions of a substantially box-shaped body, and a rotating shaft 60 is laid between substantially central parts of the respective fixed side walls 52. The rotating shaft 60 is fitted with a plurality of rough crush blades 54, . . . provided at predetermined intervals and arrangement, and with crush blades 56, . . . arranged between the fixed side walls 52 and the rough crush blades 54 and between the rough crush blades 54. It is to be noted that the orbit of the tip parts of the rough crush blades 54 and crush blades 56 are drawn in broken lines in the figure. A pair of rocking side walls 53, 53 are arranged at the other opposed positions of the substantially box-shaped body so as to be able to rock around rocking shafts 62, 62 which are parallel to the rotating shaft 60. The respective fixed side walls 52 and the respective rocking side walls 53 make up a casing.

At the inner side of one rocking side wall 53, a fixed blade 57, which is composed of a plurality of first fixed blades 57*a*, . . . and a second fixed blade 57*b*, is fixed at a predetermined position. The first fixed blades 57*a* mainly crush sprue runners into crush debris having a predetermined pellet size in cooperation with the crush blades 56, and the second fixed blade 57*b* makes it easy for the sprue runners to be bitten by the crush blades 56, in cooperation with the rough crush blades 54. Moreover, at the inner side of the rocking side wall 53, a rough crush blade cover 61 for preventing discharge of material roughly crushed by the rough crush blades 54 is provided. The rough crush blade cover 61 forms arcuate space inside thereof so as to cover the rotation orbit of the rough crush blades 54. At the inner side of the other rocking side wall 53, a scraper 55 for scraping and discharging crush debris crushed by the crush blades 56 is fixed at a predetermined position and a rough crush blade cover 61 is provided.

By rotating the rocking side walls 53 about the rocking shafts 62 for a closing operation with handles 64, contact surfaces 61*a* of the respective rough crush blade covers 61 come into contact with each other, preventing discharge of material roughly crushed by the rough crush blades 54. Moreover, by rotating the rocking side walls 53 about the rocking shafts 62 and supporting the rocking side walls 53 with supporting members 63, a double swing structure of the casing body is realized. With such a structure, it becomes possible to achieve the cleaning task without detaching the rough crush blades 54 and the crush blades 56 or the like for disassembly.

Moreover, produced is a chopping machine (crusher), maintenance of which can be performed easily with a structure wherein a rough crush blade cover is separated into a rough crush blade cover fixed at a rocking side wall and a rough crush blade casing detachable from a rocking side wall, the detachable rough crush blade casing (an intermediate member of a rough crush blade cover) is placed at the lower side of the rotating shaft, and the rough crush blade casing is supported with a clamp cam (see, Japanese Patent Application Laid-Open No. 2004-105863).

SUMMARY

However, in a conventional crusher, when a rocking side wall is opened, the blade edge of a rough crush blade and the rough crush blade cover interfere with each other in some stop positions of the rough crush blade provided with a blade edge having a large rotational radius, and it is therefore necessary to open the rocking side wall while rotating a rough crush blade by hand and the working property is low. Moreover, even in a state where the rocking side wall is open, it is impossible to rotate the rough crush blades and the crush blades by 360 degrees for cleaning since the blade edge of a rough crush blade and the rough crush blade cover interfere with each other and, furthermore, it is difficult to clean some parts since clearance between the rough crush blades and crush blades and the rough crush blade cover is small at the lower side of the rotating shaft.

Moreover, in a chopping machine (crusher) of the Patent Literature 1 wherein a part (rough crush blade casing) of the rough crush blade cover is formed to be detachable so as to enhance the working property of cleaning, attachment and detachment of the rough crush blade casing sometimes becomes difficult in a crusher of a type having high output which requires a larger and heavier rough crush blade casing. Moreover, when the rough crush blade casing is detached in cleaning, attachment of the rough crush blade casing could possibly be forgotten accidentally when the device is activated, causing discharge of material, which has been roughly crushed by the rough crush blades but has not been crushed into a predetermined size.

The present invention has been made in view of such a situation, and it is an object thereof to provide a crusher wherein a rocking axis of a rocking side wall is made to move from a first rocking shaft, which is placed below a rotating shaft and is parallel to the rotating shaft, to a second rocking shaft, which is placed outside of the first rocking shaft and is parallel to the first rocking shaft, when the rocking side wall is opened, and a rocking axis of a rocking side wall is made to move from the second rocking shaft to the first rocking shaft when the rocking side wall is closed, so that an interference between a rocking side wall and a rotating blade can be prevented, and the size of an opening between lower parts of the rocking side walls can be set further greater that the conventional type to facilitate cleaning of crush debris, reducing cleaning time and preventing crush debris from remaining in the crusher.

Moreover, another object of the present invention is to provide a crusher wherein the first rocking shaft is made to rock around the second rocking shaft when a rocking side wall is opened and closed, so that the rocking side wall can be opened and closed by only a rotating operation to facilitate the opening and closing motion of the rocking side wall.

Moreover, another object of the present invention is to provide a crusher wherein a rocking side wall has a lock part to be locked at a connection member for connecting the first rocking shaft with the second rocking shaft in the middle of the rocking motion around the first rocking shaft when the rocking side wall is opened, and the rocking side wall is made to rotate about the second rocking shaft in operative association with the connection member when the lock part is locked at the connection member, so that it is unnecessary to form a part of a rough crush blade cover to be detachable and an opening between the rocking side walls can be widened with a simple structure.

Moreover, another object of the present invention is to provide a crusher wherein the first rocking shaft is disposed perpendicularly on a sliding surface of a rocking side wall against a fixed side wall and a minor-arc race for guiding the first rocking shaft, which rocks around the second rocking shaft in accordance with the rocking motion of the rocking side wall, is provided at a sliding surface of the fixed side wall against the rocking side wall, so that it is unnecessary to form a part of the rough crush blade cover to be detachable and an opening between the rocking side walls can be widened with a simple structure.

Moreover, another object of the present invention is to provide a crusher wherein the first rocking shaft is disposed perpendicularly on a sliding surface of a fixed side wall against a rocking side wall and a minor-arc race for guiding the first rocking shaft in accordance with the rocking motion of the rocking side wall is provided at a sliding surface of the rocking side wall against the fixed side wall, so that it is unnecessary to form a rotating blade cover and an opening between the rocking side walls can be widened with a simple structure.

Moreover, another object of the present invention is to provide a crusher wherein a rocking side wall is provided with a first fitting member for positioning of the rocking side wall in the vertical direction with both rocking side walls being closed and a fixed side wall is provided with a second fitting member to be fitted with the first fitting member, so that deviation of the rocking side wall in the vertical direction in the closing motion of the rocking side wall can be prevented and damage to a blade edge of a fixed blade and the rotating blade can be prevented.

The crusher of the invention includes a pair of rocking side walls that can be rocked to open and close and have an upward opening; a rotating shaft having a rotating blade at a space enclosed by both rocking side walls, for crushing an object with a fixed blade provided at an inner side of one of the rocking side wall and the rotating blade in cooperation with each other; a first rocking shaft, which is placed below the rotating shaft and is parallel to the rotating shaft, for rocking each rocking side wall; a second rocking shaft, which is placed outside of the first rocking shaft and is parallel to the first rocking shaft, for rocking each rocking side wall; a rocking axis of the rocking side walls is made to move from the first rocking shaft to the second rocking shaft when the rocking side walls are to be opened; and a rocking axis of the rocking side walls is made to move from the second rocking shaft to the first rocking shaft when the rocking side walls are closed.

In the crusher of the invention includes the first rocking shaft is constructed to rock around the second rocking shaft when the rocking side walls are to be opened and closed.

In the crusher of the invention includes a pair of fixed side walls are arranged at both end parts of the rotating shaft with both rocking side walls sandwiched therebetween; the first rocking shaft is provided at each rocking side wall, and the second rocking shaft is provided at each fixed side wall; a connection member for connecting the first rocking shaft with the second rocking shaft; the rocking side walls have a lock part to be locked at the connection member in the middle of rotation about the first rocking shaft when the rocking side walls are to be opened; and the rocking side walls are constructed to rotate about the second rocking shaft in operative association with the connection member when the lock part is locked at the connection member.

In the crusher of the invention includes a pair of fixed side walls having sliding surfaces against the rocking side walls are arranged at both end parts of the rotating shaft with both rocking side walls sandwiched therebetween; the first rocking shaft is disposed perpendicularly on a sliding surface of the rocking side walls against each fixed side wall; and a minor-arc race for guiding the first rocking shaft, which rocks around the second rocking shaft in accordance with a rocking motion of the rocking side walls, is provided at a sliding surface of the fixed side walls against the rocking side walls.

In the crusher of the invention includes a pair of fixed side walls having sliding surfaces against the rocking side walls are arranged at both end parts of the rotating shaft with both rocking side walls sandwiched therebetween; the first rocking shaft is disposed perpendicularly on a sliding surface of the fixed side walls against each rocking side wall; and a minor-arc race for guiding the first rocking shaft in accordance with a rocking motion of the rocking side walls is provided at a sliding surface of the rocking side walls against the fixed side walls.

In the crusher of the invention includes the rocking side walls are provided with a first fitting member for positioning of the rocking side walls in a vertical direction with both rocking side walls closed; and the fixed side walls are provided with a second fitting member to be fitted with the first fitting member.

According to the present invention, when a rocking side wall which is closed is to be opened, the rocking side wall is first rotated about the axis of a first rocking shaft which is parallel to a rotating shaft of a rotating blade and is placed below the rotating shaft. Since the rocking shaft of the rocking side wall is placed below the rotating shaft, a part of the rocking side wall adjacent to the rotating blade moves away from the rotating blade with rotation of the rocking side wall in the arcuate movement around the rocking shaft, and the rocking side wall can be opened without an interference with the rotating blade. The rocking axis of the rocking side wall moves to a second rocking shaft, which is parallel to the first rocking shaft and placed outside of the first rocking shaft, in the middle of the opening motion of the rocking side wall, and the rocking side wall is rotated about the second rocking shaft and opened. Since the rocking side wall is rotated about the outer second rocking shaft, the rocking side wall is opened while being further away from the rotating blade, and this widens an opening between the rocking side walls. Moreover, when the rocking side wall is to be closed, the rocking side wall is first rotated about the axis of the second rocking shaft and the rocking axis of the rocking side wall moves from the second rocking shaft to the first rocking shaft in the middle of the closing motion of the rocking side wall.

According to the present invention, when a rocking side wall is to be opened and closed, the first rocking shaft rocks around the second rocking shaft. For example, when a rocking side wall is to be opened, the rocking side wall is first rotated about the first rocking shaft and then moved to be rotated about the second rocking shaft in the middle of rotation and the first rocking shaft is rotated about the second rocking shaft. With such a structure, it is possible to prevent the first rocking shaft from being fixed in the middle of rotation of the rocking side wall, rotation of the rocking side wall can be moved smoothly and the rocking side wall can be opened by only a rotating operation, since the rocking side wall is rotated about the second rocking shaft and the first rocking shaft moves in an arc around the second rocking shaft. On the contrary, when a rocking side wall is to be closed, the rocking side wall is first rotated about the second rocking shaft and the first rocking shaft is rotated about the second rocking shaft. The rocking side wall is moved to be rotated about the first rocking shaft in the middle of rotation. With such a structure, it is possible to prevent the first rocking shaft from being fixed, rotation of the rocking side wall can be moved smoothly even when the rocking axis of the rocking side wall moves from the second rocking shaft to the first rocking shaft, and the rocking side wall can be closed by only a rotating operation, since the rocking side wall is rotated about the second rocking shaft and the first rocking shaft moves in an arc around the second rocking shaft.

According to the present invention, a pair of fixed side walls are arranged at both end parts of the rotating shaft with both rocking side walls sandwiched therebetween, the first rocking shaft is provided at each rocking side wall and the second rocking shaft is provided at each fixed side wall. The connection member, for example, connects the first rocking shaft with the second rocking shaft so as to limit movement of the first rocking shaft around the second rocking shaft with the rocking motion of the rocking side wall. The rocking side wall has a lock part, which is first rotated about the first rocking shaft and is locked at the connection member in the middle of rotation when the rocking side wall is to be opened. When the lock part is locked at the connection member in the middle of rotation of the rocking side wall about the first rocking shaft, the rocking side wall is rotated about the second rocking shaft in operative association with the connection member. In such a case, the first rocking shaft is rotated about the second rocking shaft by the connection member with rotation of the rocking side wall. With such a structure, rotation of the rocking side wall can be moved smoothly even when the rocking axis of the rocking side wall moves from the second rocking shaft to the first rocking shaft, an interference between the rocking side wall and the rotating blade can be prevented with a simple structure without providing a rotating blade cover, and an opening between the rocking side walls can be widened.

According to the present invention, a pair of fixed side walls having sliding surfaces against the rocking side walls are arranged at both end parts of the rotating shaft with both rocking side walls sandwiched therebetween and the first rocking shaft is disposed perpendicularly on a sliding surface of each rocking side wall against a fixed side wall. A minor-arc race for guiding the first rocking shaft, which rocks around the second rocking shaft in accordance with the rocking motion of the rocking side wall, is provided at a sliding surface of the fixed side wall against the rocking side wall. For example, when a rocking side wall is to be opened, the rocking side wall is first rotated about the first rocking shaft and then moved to be rotated about the second rocking shaft in the middle of rotation and the first rocking shaft is rotated about the second rocking shaft in an arc along the race without being fixed. With such a structure, rotation of the rocking side wall can be moved smoothly even when the rocking axis of the rocking side wall moves from the second rocking shaft to the first rocking shaft, an interference between the rocking side wall and the rotating blade can be prevented with a simple structure without forming a part of the rough crush blade cover to be detachable, and an opening between the rocking side walls can be widened.

According to the present invention, a pair of fixed side walls having sliding surfaces against the rocking side walls are arranged at both end parts of the rotating shaft with both rocking side walls sandwiched therebetween and the first rocking shaft is disposed perpendicularly on a sliding surface of a fixed side wall against a rocking side wall. A minor-arc race for guiding the first rocking shaft in accordance with the rocking motion of the rocking side wall is provided at a sliding surface of the rocking side wall against the fixed side wall. For example, when a rocking side wall is to be opened, the rocking side wall is first rotated about the first rocking shaft and then moved to be rotated about the second rocking shaft in the middle of rotation, and the race moves with rotation of the rocking side wall so as to guide the first rocking shaft. With such a structure, rotation of the rocking side wall can be moved smoothly even when the rocking axis of the rocking side wall moves from the second rocking shaft to the first rocking shaft, an interference between the rocking side wall and the rotating blade can be prevented with a simple structure without forming a part of the rough crush blade cover to be detachable, and an opening between the rocking side walls can be widened.

According to the present invention, a rocking side wall is provided with a first fitting member for positioning of the rocking side wall in the vertical direction with both rocking side walls closed, and a fixed side wall is provided with a second fitting member to be fitted with the first fitting member. With such a structure, deviation of the rocking side wall in the vertical direction in the closing motion of the rocking side wall can be prevented and damage to the blade edge of the fixed blade and the rotating blade in the opening and closing motion can be prevented.

In the present invention, a rocking axis of a rocking side wall is made to move from a first rocking shaft, which is placed below a rotating shaft and is parallel to the rotating shaft, to a second rocking shaft, which is placed closer to the outside than the first rocking shaft and is parallel to the first rocking shaft, when the rocking side wall is to be opened, and a rocking axis of the rocking side wall is made to move from the second rocking shaft to the first rocking shaft when the rocking side wall is to be closed, so that an interference between the rocking side wall and the rotating blade can be prevented, and the size of an opening between the rocking side walls can be set further greater to facilitate cleaning of crush debris, reducing cleaning time and preventing crush debris from remaining in the crusher.

In the present invention, the first rocking shaft is constructed to rock around the second rocking shaft when a rocking side wall is to be opened and closed, so that the rocking side wall can be opened and closed by only a rotating operation to facilitate the opening and closing motion of the rocking side wall.

In the present invention, a rocking side wall has a lock part to be locked at a connection member for connecting the first rocking shaft with the second rocking shaft in the middle of the rocking motion around the first rocking shaft when the rocking side wall is to be opened, and the rocking side wall is constructed to rotate about the second rocking shaft in operative association with the connection member when the lock part is locked at the connection member, so that it is unnecessary to provide a rotating blade cover and an opening between the rocking side walls can be widened with a simple structure.

In the present invention, the first rocking shaft is disposed perpendicularly on a sliding surface of a rocking side wall against a fixed side wall and a minor-arc race for guiding the first rocking shaft, which rocks around the second rocking shaft in accordance with the rocking motion of the rocking side wall, is provided at a sliding surface of the fixed side wall against the rocking side wall, so that it is unnecessary to provide a rotating blade cover and an opening between the rocking side walls can be widened with a simple structure.

In the present invention, the first rocking shaft is disposed perpendicularly on a sliding surface of a fixed side wall against a rocking side wall and a minor-arc race for guiding the first rocking shaft in accordance with the rocking motion of the rocking side wall is provided at a sliding surface of the rocking side wall against the fixed side wall, so that it is unnecessary to provide a part of the rough crush blade cover to be detachable and an opening between the rocking side walls can be widened with a simple structure.

In the present invention, a rocking side wall is provided with a first fitting member for positioning of the rocking side wall in the vertical direction with both rocking side walls closed and a fixed side wall is provided with a second fitting member to be fitted with the first fitting member, so that deviation of the rocking side wall in the vertical direction in the closing motion of the rocking side wall can be prevented and damage to a blade edge of a fixed blade and the rotating blade in the opening and closing motion can be prevented.

The above and further objects and features will more fully be apparent from the following detailed description with accompanying drawings.

DETAILED DESCRIPTION

Embodiment 1

Figure 1:
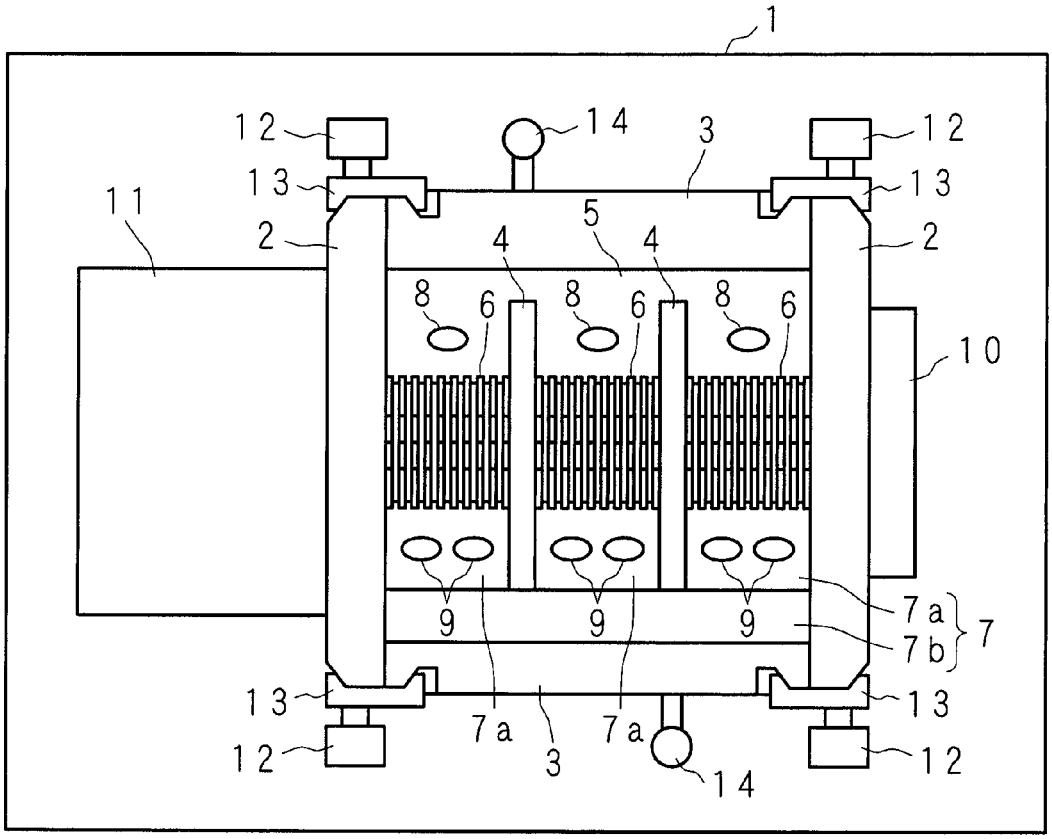
FIG. 1 is a schematic top view for illustrating an essential part of a crusher according to the present invention

The following description will explain the present invention with reference to the drawings illustrating some embodiments thereof. FIG. 1 is a schematic top view for illustrating an essential part of a crusher according to the present invention. In the figure, denoted at 1 is a supporting table which is made of metal to have an opening at a central part. A pair of fixed side walls 2, 2, which are made of metal at an appropriate distance from each other, are disposed to face each other on the upper surface of the supporting table 1, a pair of rocking side walls 3, 3, which are made of metal, are arranged at both side parts of the fixed side walls 2, 2 so as to be sandwiched between the fixed side walls 2, 2, and the fixed side walls 2, 2 and the rocking side walls 3, 3 make up a casing.

A bearing 10 is attached to a substantially central part of one fixed side wall 2, an electric motor 11 provided with a reduction gear is attached to the other fixed side wall 2, and a rotating shaft (not illustrated) associated with the motor shaft of the electric motor 11 is laid between the fixed side walls 2, 2.

Rough crush blades 4, 4 and crush blades 6, 6, 6, which are fitted with the rotating shaft (not illustrated), are held in a space surrounded by the fixed side walls 2, 2 and the rocking side wall 3, 3. The rough crush blades 4, 4 have an arm-like shape with a tip part (blade edge part) curved toward the rotational direction and are arranged at an appropriate distance from each other in the axial direction of the rotating shaft. The crush blades 6, 6, 6 are arranged between the fixed side walls 2 and the rough crush blades 4 and between the rough crush blades 4, 4, and annular grooves are formed at predetermined intervals in the rotating shaft direction so that the peripheral surface of annular projections between adjacent annular grooves are formed in a serrate shape.

The rocking side walls 3, 3 can respectively rock around a rocking shaft, which is parallel to the rotating shaft, as described below and the casing is opened upwardly when the rocking side walls 3, 3 are opened. At the inner side of one rocking side wall 3, a fixed blade 7, which is composed of rectangle-plate-like first fixed blades 7*a*, . . . for crushing an object (sprue runners) in cooperation with the respective rough crush blades 4 and respective crush blades 6 and a second fixed blade 7*b*, is fixed so as to slant in a downward direction toward the inner side.

The first fixed blades 7*a* have a longitudinal dimension which is substantially equal to the axial dimension of the crush blades 6, and one edge part at a long side has a tooth part, which is formed to have concavities and convexities so as to engage with the blade edges of the crush blade 6, and is fixed at the inner side of the rocking side wall 3 with bolts 9, . . . . Moreover, a tooth part for crushing an object in cooperation with the rough crush blades 4 is formed at an edge part, which is at a short side of the first fixed blades 7*a* and is adjacent to the rough crush blades 4.

The second fixed blade 7*b* has a longitudinal dimension which is substantially equal to the axial dimension of the rocking side wall 3, and a tooth part for crushing an object in cooperation with the rough crush blades 4 is formed at a position, which is one edge part at a long side and is adjacent to the rough crush blades 4. The second fixed blade 7*b* is fixed at the inner side of the rocking side wall 3 with bolts (not illustrated) so as to come into contact with the other edge part at a long side of the first fixed blades 7*a*, . . . .

At the inner side of the rocking side wall 3 below the fixed blade 7, a rough crush blade cover, which will be described below, is provided in order to prevent discharge of an object which has been roughly crushed by the rough crush blades 4, 4 but has not been crushed into a predetermined size. Arcuate grooving is applied to the inner side of the rough crush blade cover so as to cover the rotation orbit of the rough crush blades 4, 4.

At the inner side of the other rocking side wall 3, a substantially rectangle-plate-like scraper 5 for scraping crush debris crushed by the crush blades 6, 6, 6 into a predetermined size (pellet size) and discharging the crush debris to an outlet (not illustrated) at the lower side of the casing is fixed with bolts 8, 8, 8 so as to slant in a downward direction toward the inner side.

The scraper 5 has a rectangular cut at a portion where the rough crush blades 4, 4 are rotated, and a scraping part, which is formed to have concavities and convexities so as to engage with the blade edges of the crush blades 6, is formed at a position, which is one edge part at a long side and is adjacent to the crush blades 6, 6, 6.

At the inner side of the rocking side wall 3 below the scraper 5, a rough crush blade cover is provided in order to prevent discharge of an object which has been roughly crushed by the rough crush blades 4, 4 but has not been crushed into a predetermined size yet. Arcuate grooving is applied to the inner side of the rough crush blade cover so as to cover the rotation orbit of the rough crush blades 4, 4. When both rocking side walls 3, 3 are closed, the respective rough crush blade covers come into contact with each other at one end part and form a space covering the rotation orbit of the rough crush blades 4, 4, preventing discharge of an object which has not been crushed yet.

Lock members 13, . . . , which respectively have one taper face, are attached to the four corners of the casing composed of the respective fixed side walls 2 and the respective rocking side walls 3 in order to fix the rocking side walls 3, 3 at the fixed side walls 2, 2, and the rocking side walls 3, 3 are fixed at the fixed side walls 2, 2 by laying the end parts of the fixed side walls 2 and the rocking side walls 3 between the taper faces and by clenching levers 12 screwed with the lock members 13. The respective rocking side walls 3 can be opened and closed with handles 14 fixed at the rocking side walls 3.

When an object is crushed, the rocking side walls 3, 3 are fixed at the fixed side walls 2, 2 by clenching the levers 12. When an object is introduced to an inlet hopper (not illustrated) placed at the upper part of the casing and the electric motor 11 is powered on, the rotating shaft is rotated at a predetermined number of revolutions and the rough crush blades 4 and the crush blades 6 are rotated. The rotational direction is the direction in which the rough crush blades 4 and the crush blades 6 engage with the fixed blade 7 from the upper side toward the lower side and engage with the scraper 5 from the lower side toward the upper side.

With such a structure, an object is first roughly crushed by the rough crush blades 4 and the fixed blade 7 in cooperation with each other and chopped into a size which makes it easy to be bitten by the crush blades 6. A roughly crushed object is crushed into crush debris having a predetermined size by the crush blades 6 and the first fixed blades 7*a* in cooperation with each other, transferred to the lower side of the casing with rotation of the crush blades 6 and discharged from the outlet (not illustrated). Moreover, some of crush debris crushed into a predetermined size, which has been attached to the side surface of the crush blades 6 by static electricity, is scraped at the lower surface of the scraper 5 by the crush blades 6 and the scraper 5 in cooperation with each other and discharged from the outlet (not illustrated).

A part of the object roughly crushed by the rough crush blades 4, which is transferred to the lower side of the fixed blade 7 with rotation of the rough crush blades 4, is received by the rough crush blade covers, which will be described below, and transferred again to the upper side of the respective crush blades 6, preventing mistaken discharge from the outlet.

Moreover, after an object is crushed, some of the crush debris remains at the surrounding surface or the blade edge of the respective rough crush blades 4, the respective crush blades 6 and the fixed blade 7, the surrounding surface of the scraper 5, the inner side of the rough crush blade covers, the inner part of the fixed side walls 2, 2, the inner part of the rocking side walls 3, 3, and the like.

Figure 2:
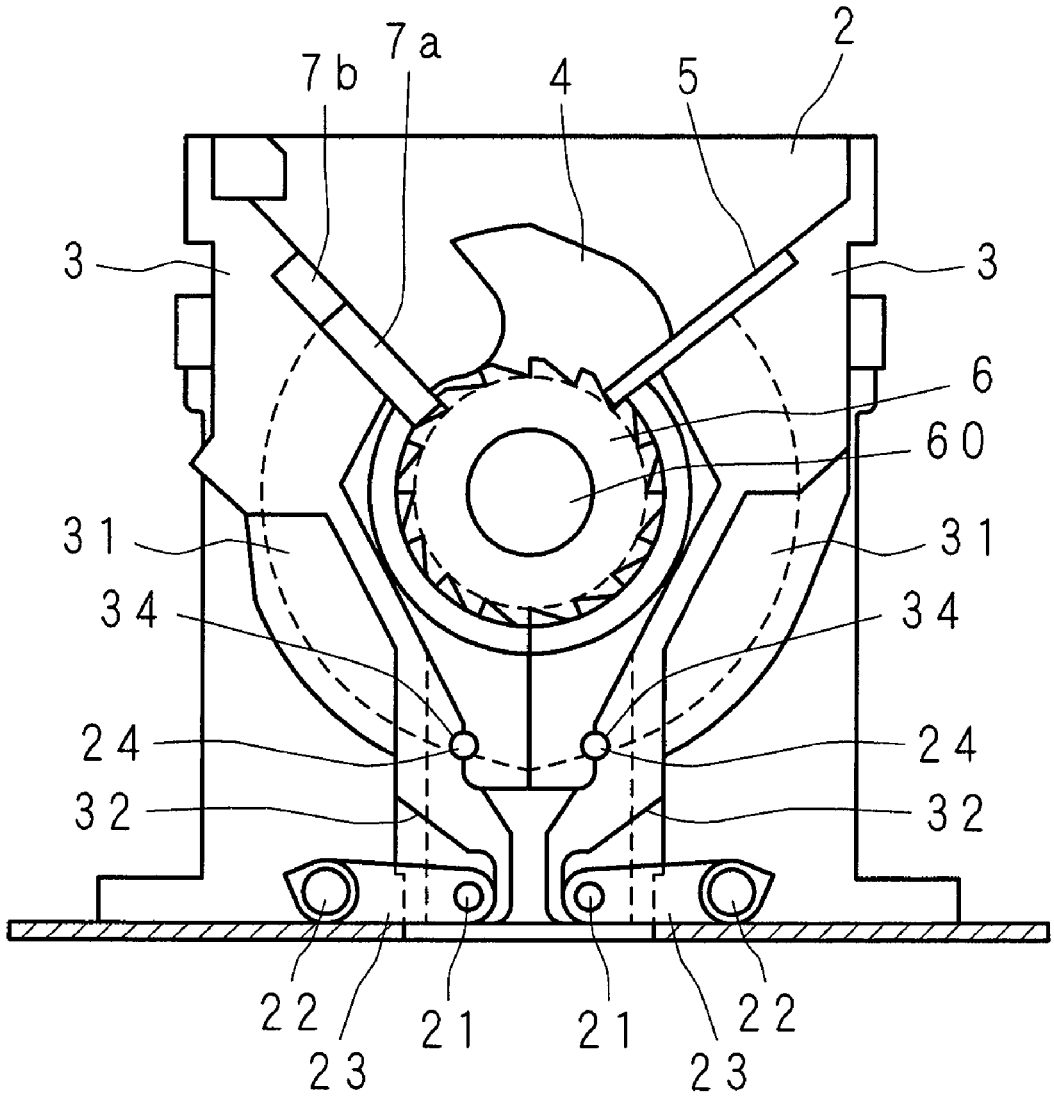
FIG. 2 is a schematic side view for illustrating an essential part of a crusher according to the present invention

FIG. 2 is a schematic side view for illustrating an essential part of a crusher according to the present invention. It is to be noted that a state where the rocking side walls 3, 3 are closed is illustrated in FIG. 2. Moreover, only an essential part is illustrated in the figure. As illustrated in the figure, a rotating shaft 60 is laid between substantially central parts of the fixed side walls 2, and the rough crush blades 4 and the crush blades 6 are fitted with the rotating shaft 60 at predetermined positions. It is to be noted that a plurality of rough crush blades 4 and a plurality of crush blades 6 are fitted, though only one rough crush blade 4 and only one crush blade 6 are illustrated in the figure. At an upper part of the inner surface of one rocking side wall 3, a fixed blade 7 (first fixed blades 7*a* and a second fixed blade 7*b*) is fixed so as to slant in a downward direction toward the rotating shaft 60, and a rough crush blade cover 31 is provided at the rotation orbit of the rough crush blades 4 below the fixed blade 7.

At an upper part of the inner surface of the other rocking side wall 3, a scraper 5 is fixed so as to slant in a downward direction toward the rotating shaft 60, and a rough crush blade cover 31 is provided at the rotation orbit of the rough crush blades 4 below the scraper 5.

The respective rough crush blade covers 31 have a minor-arc annular shape having a predetermined thickness, and the inner side thereof forms a space in which grooving is applied along the rotation orbit of the rough crush blades 4. In a state where the rocking side walls 3, 3 are closed, one end parts of the rough crush blade covers 31 come into contact with each other and receive untreated crush debris which has come under the fixed blade 7 and the scraper 5 with rotation of the rough crush blades 4.

On surfaces of the rocking side walls 3, which are adjacent to the fixed side walls 2 and substantially perpendicularly below the rotating shaft 60, shaft bodies 21, 21 (first rocking shafts) are disposed perpendicularly, parallel to the axial direction of the rotating shaft 60. Shaft bodies 22, 22 (second rocking shafts) are disposed vertically on surfaces of the fixed side walls 2, which are adjacent to the rocking side walls 3, parallel to the axial direction of the shaft bodies 21 so as to be on a nearly-level with the respective shaft bodies 21 and closer to the outside than the shaft bodies 21.

A substantially elliptical connection plate 23 having insertion holes, to which the shaft bodies 21, 22 are inserted, is attached to each shaft bodies 21, 22 between a fixed side wall 2 and a rocking side wall 3 so as to be able to rotate about the shaft bodies 21, 22. A cutout surface 32, which slants in a downward direction from the outer side toward the inner side, is formed above each connection plate 23 of a rocking side wall 3. It is to be noted that the cutout surface 32, which comes into contact with an upper side surface of the connection plate 23 so as to lock a rocking side wall 3 and a connection plate 23 and be rotated in operative association when the rocking side wall 3 is opened, is not limited to a plane, and can be set as an arbitrary shape, such as a curved face or a concavo-convex shape, as long as the shape enables locking.

Cylindrical fixing pins 24 are disposed perpendicularly on the sliding surfaces of the fixed side walls 2 against the rocking side walls 3 below the rotating shaft 60 at an appropriate distance from each other, and a semi-arc fitting surface 34 to be fitted with each fixing pin 24 is formed at the sliding surface of each rocking side wall 3 against a fixed side wall 2, with the rocking side wall 3 closed. With such a structure, deviation of the rocking side walls 3 in the vertical direction in the closing motions of the rocking side walls 3 is prevented and damage to blade edges due to an interference of the blade edges of the rough crush blades 4, the crush blades 6 and the like with the blade edge of the fixed blade 7, the scraper 5 and the like in the opening and closing motion of the rocking side walls 3 is prevented.

Figure 3:
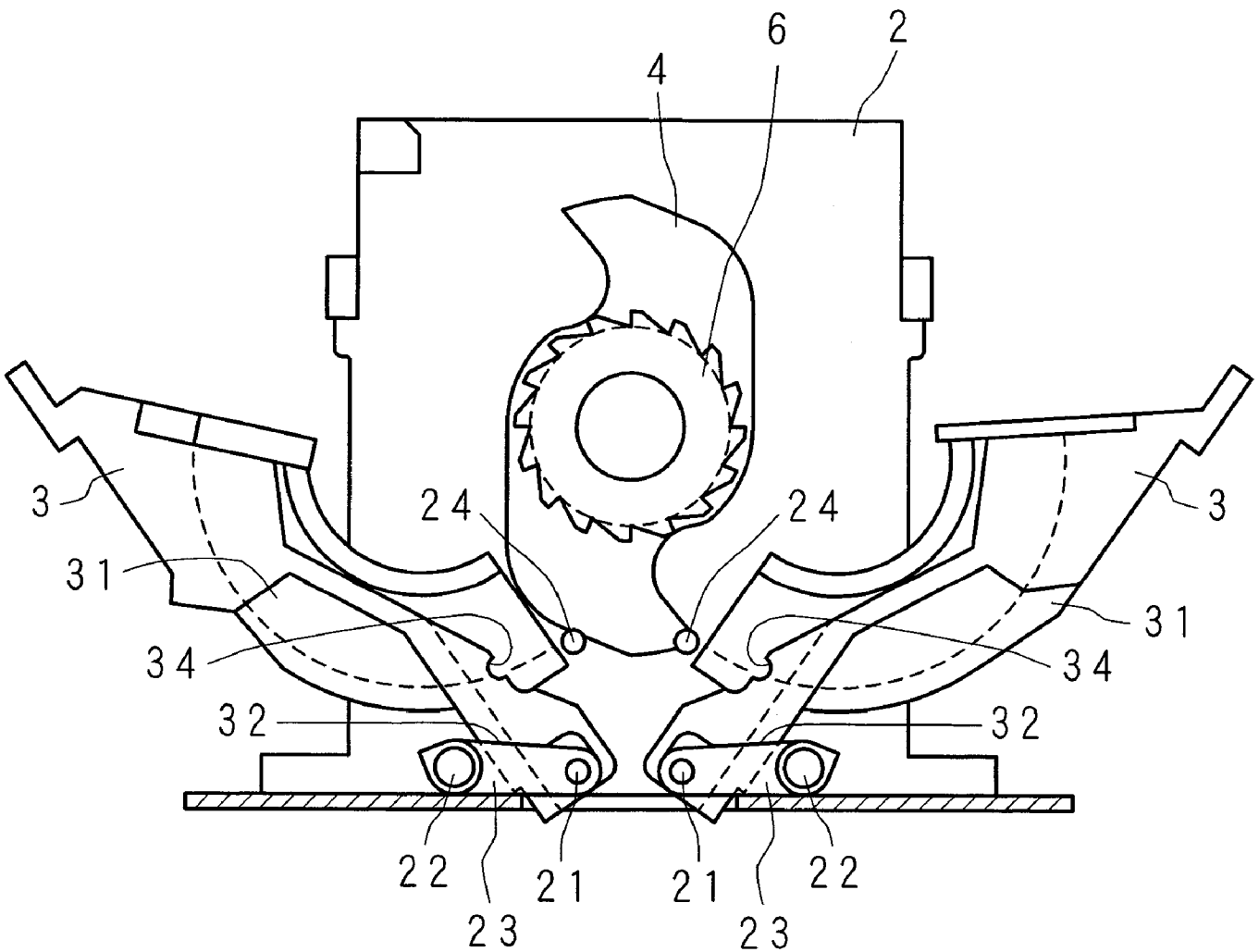
FIG. 3 is a schematic side view for illustrating an essential part of a crusher in the opening and closing motion of a rocking side wall
Figure 4:
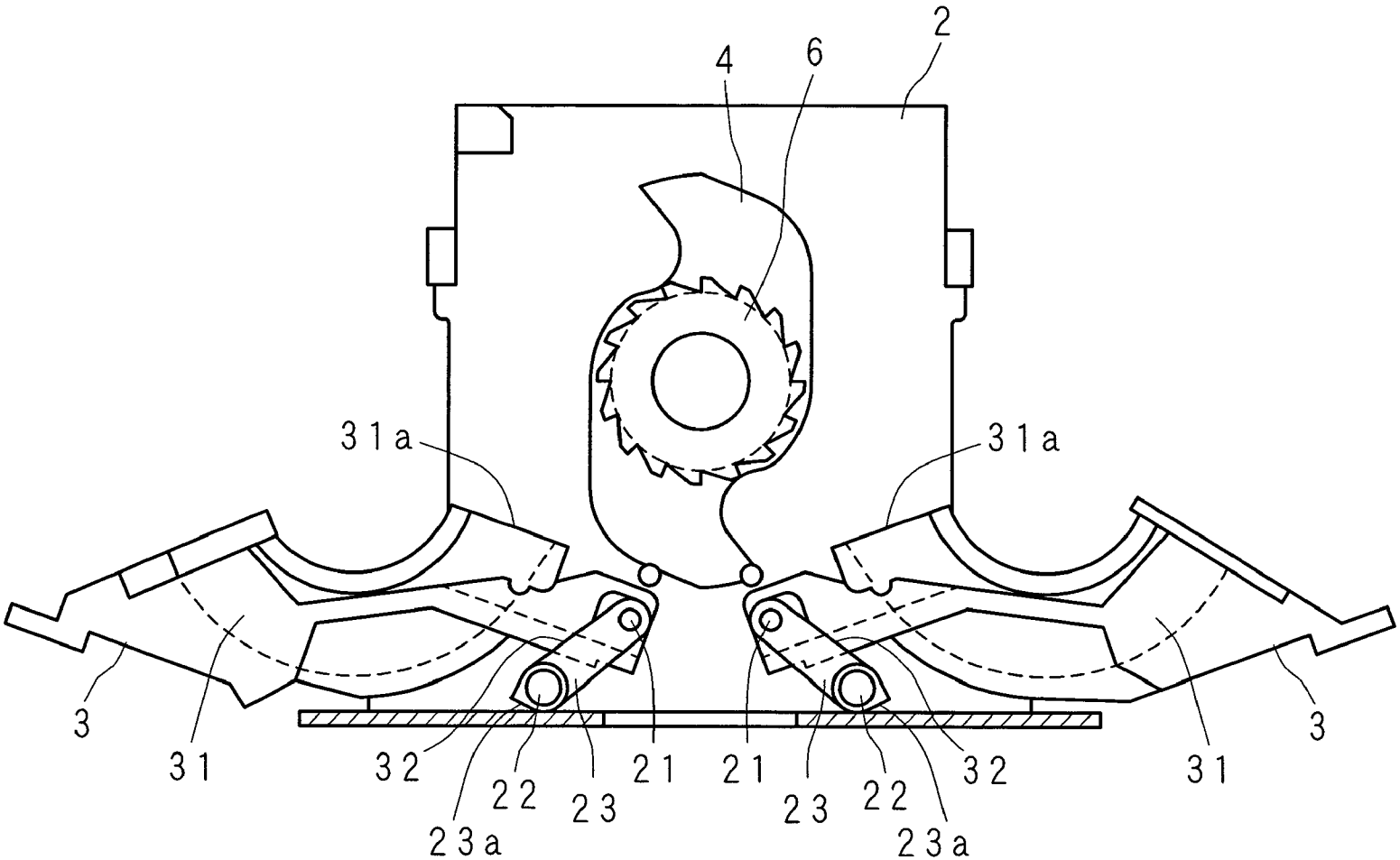
FIG. 4 is a schematic side view for illustrating an essential part of a crusher in the opening and closing motion of a rocking side wall
Figure 5:
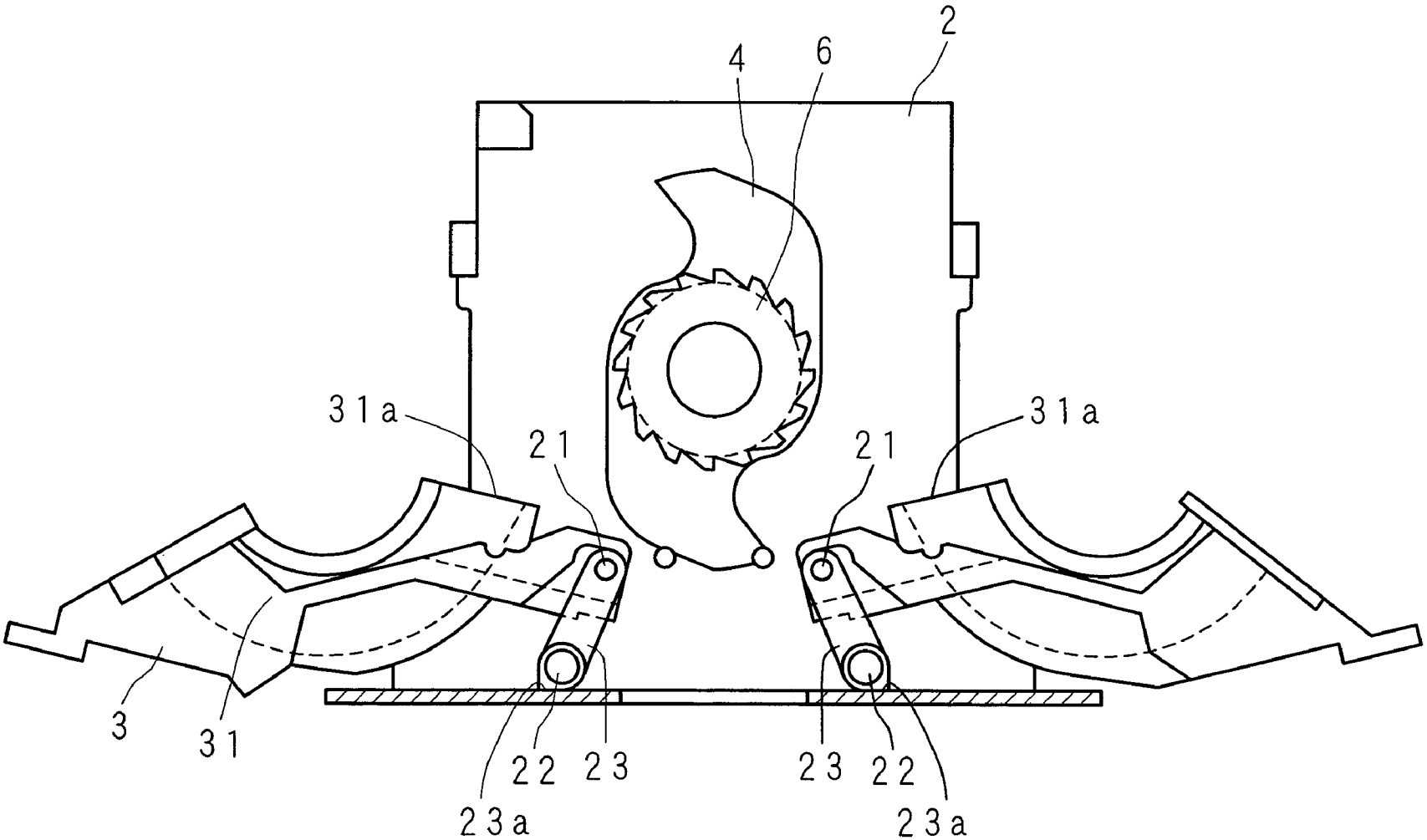
FIG. 5 is a schematic side view for illustrating an essential part of a crusher in the opening and closing motion of a rocking side wall

Next, a state of the rocking side walls 3 in the opening and closing motions will be explained. FIGS. 3 to 5 are schematic side views for illustrating an essential part of a crusher in the opening and closing motions of the rocking side walls 3. As illustrated in FIG. 3, at an early stage of the opening motion of the rocking side walls 3, the rocking side walls 3 are rotated about the shaft bodies 21 until the cutout surfaces 32 formed at the rocking side walls 3 come into contact with upper side surfaces of the connection plates 23.

In such a case, since the rotation center of each rocking side wall 3 is a shaft body 21 placed substantially vertically below the rotating shaft 60, an end part or an edge part of a rough crush blade cover 31 provided at the inner side of the rocking side wall 3, which is a part adjacent to a rough crush blade 4 or a crush blade 6, moves in an arc around the shaft body 21. With such a structure wherein an end part or the edge part of each rough crush blade cover 31 moves away from the rough crush blade 4 or the crush blade 6 with rotation of the rocking side wall 3, the rocking side wall 3 can be opened without an interference of the inner part (especially the rough crush blade cover 31) of the rocking side wall 3 with the rough crush blade 4 or the crush blade 6.

As illustrated in FIG. 4, when the rocking side walls 3 are further opened in a state where the cutout surfaces 32 formed at the rocking side walls 3 are in contact with upper side surfaces of the connection plates 23, the rocking side walls 3 are rotated about the shaft bodies 22 in operative association with the connection plates 23. That is, the rocking shaft of each rocking side wall 3 moves from a shaft body 21 to a shaft body 22 in the middle of the opening motion of the rocking side wall 3. When the rocking side walls 3 are rotated about the shaft bodies 22 placed closer to the outside than the shaft bodies 21, the rocking side walls 3 are opened while being further away from the rough crush blades 4 and the crush blades 6, and this widens the opening between the rocking side walls 3.

Moreover, the shaft bodies 21 provided at the rocking side walls 3 are rotated about the shaft bodies 22 in an arc by the action of the connection plates 23 in rotation of the rocking side walls 3 about the shaft bodies 22 after the rocking shafts of the rocking side walls 3 move from the shaft bodies 21 to the shaft bodies 22. With such a structure wherein the rocking side walls 3 are rotated about the shaft bodies 22 and the shaft bodies 21 move in an arc around the shaft bodies 22, it is possible to prevent the shaft bodies 21 from being fixed in the middle of rotation of the rocking side walls 3, rotation of the rocking side walls 3 can be moved smoothly, it is also unnecessary to slide the rocking side walls 3 in a horizontal direction, and the rocking side walls 3 can be opened by only a rotating operation.

When the rocking side walls are to be opened, it is possible to slide (parallel translation) the rocking side walls a predetermined distance in a horizontal direction toward the outside in order to avoid an interference with the rough crush blades and the crush blades, and then rotate the rocking side walls to widen the opening. However, the self-weight of the rocking side walls is heavy, and the rocking side walls become larger and the weight becomes further heavier as the output of the crusher becomes larger. Consequently, with a structure wherein the rocking side walls are translated parallel and drawn, the worker has to draw the rocking side walls with considerable power. On the other hand, since fine powder material remains at clearance between the rocking side walls and the fixed side walls or at the lower surfaces of the rocking side walls, this causes increase in frictional force and further lowering of the working property, and the worker could be injured unexpectedly while drawing the rocking side walls with all his strength.

Moreover, since the rocking side walls are arranged to be sandwiched between both fixed side walls and sliding surfaces of the rocking side walls and the fixed side walls are adjacent to each other, there is another problem that offset load is applied to a rocking side wall when the load center of the rocking side wall shifts from a central part of the rocking side wall in the lateral direction or the vertical direction in parallel translation of the rocking side wall, and the rocking side wall cannot move parallel to a fixed side wall, a part of the sliding surface of the rocking side wall comes into contact with the fixed side wall and the rocking side wall cannot be moved. Furthermore, when the rocking side walls are translated horizontally and then rotated, the direction of the operation load of the rocking side walls changes drastically from the horizontal direction to the rotational direction in the middle of the movement of the rocking side walls and it is therefore necessary to check the direction of the movement of the rocking side walls carefully, and the working property is low.

In the present invention wherein the opening and closing motion of the rocking side walls 3 can be achieved by only rotational movement, the rocking side walls 3 can be opened and closed smoothly. Moreover, the effect of friction or the effect of offset load is small in comparison with the case of parallel translation, the rocking side walls 3 can be opened and closed easily without a large force applied by the worker even when the device becomes larger and the weight of the rocking side walls 3 increases, and the problems described above in the case of parallel translation of the rocking side walls can be solved.

When the rocking side walls 3 are further opened as illustrated in FIG. 5, the rocking side walls 3 are rotated about the shaft bodies 22 and lock surfaces 23*a*, which are provided at end parts of the connection plates 23 on the shaft bodies 22 side, come into contact with the upper surface of the supporting table 1, and therefore further rotation of the rocking side walls 3 is restricted. It is to be noted that explanation of a case where the rocking side walls 3 are to be closed is omitted since an operation opposite to the operation described above is performed.

As illustrated in FIG. 5, the size of an opening between the rocking side walls 3 is set further greater in a state where the rocking side walls 3 are opened. Especially, since end surfaces 31*a* of the rough crush blade covers 31 are located away from the rough crush blades 4 and the crush blades 6 so as to be closer to the outside, it is unnecessary to form a rough crush blade cover to be detachable as in a conventional crusher, and an opening between the rocking side walls 3 can be widened with a simple structure. This facilitates cleaning of crush debris, reduces cleaning time and prevents crush debris from remaining in the crusher. Especially, when a molding step, a crush step, a recycle step and the like are performed in an integrated system at a molding plant, it is necessary to completely remove crush debris remaining in the crusher every time a component to be produced is changed in high-mix low-volume production, and the present invention, which can completely clean remaining crush debris in a short time, can enhance the overall production capacity of the production process and has a beneficial effect. Furthermore, since it becomes unnecessary to form a detachable rough crush blade cover, it becomes unnecessary to form a clamp cam for supporting a rough crush blade cover, and therefore the number of components can be reduced. Moreover, even when a device becomes larger, it is unnecessary to detach a heavy-weight rough crush blade cover, and the working property is enhanced.

Though the connection plates 23 in the embodiment described above have a substantially elliptical plate shape, the shape of the connection plates 23 is not limited to this and can be any shape, such as a bar or a combination of a plurality of members, as long as the shape enables connection of the respective rocking shafts. Especially, the shape can be decided arbitrarily in accordance with the shape of the fixed side walls 2 and the rocking side walls 3.

Embodiment 2

Though the Embodiment 1 described above has a structure wherein the connection plates 23 are used, the present invention is not limited to this and the opening can be also widened by opening and closing the rocking side walls by only rotational movement with other structures.

Figure 6:
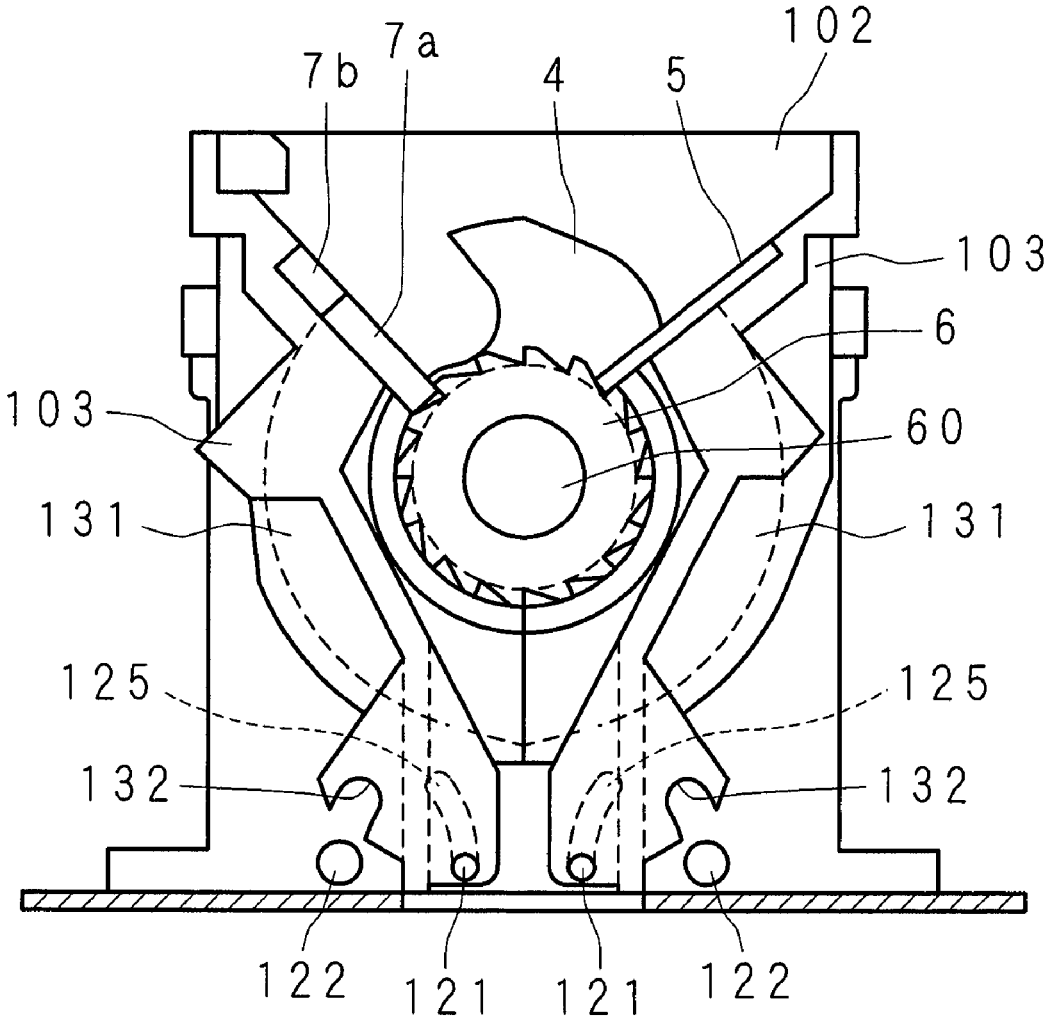
FIG. 6 is a schematic side view for illustrating an essential part of a crusher according to Embodiment 2

FIG. 6 is a schematic side view for illustrating an essential part of a crusher according to Embodiment 2. It is to be noted that a state where rocking side walls 103, 103 are closed is illustrated in FIG. 6. As illustrated in the figure, a rotating shaft 60 is laid between substantially central parts of fixed side walls 102, and rough crush blades 4 and crush blades 6 are fitted with the rotating shaft 60 at predetermined positions. At an upper part of the inner surface of one rocking side wall 103, a fixed blade 7 (first fixed blades 7*a* and a second fixed blade 7*b*) is fixed so as to slant in a downward direction toward the rotating shaft 60, and a rough crush blade cover 131 is provided at the rotation orbit of the rough crush blades 4 below the fixed blade 7.

At an upper part of the inner surface of the other rocking side wall 103, a scraper 5 is fixed so as to slant in a downward direction toward the rotating shaft 60, and a rough crush blade cover 131 is provided at the rotation orbit of the rough crush blades 4 below the scraper 5.

The respective rough crush blade covers 131 have a minor-arc annular shape having a predetermined thickness, and grooving is applied to the inner side thereof along the rotation orbit of the rough crush blades 4. In a state where the rocking side walls 103, 103 are closed, an end part of one of the rough crush blade cover 131 comes into contact with that of the other rough crush blade cover 131 and receive untreated crush debris which has come under the fixed blade 7 and the scraper 5 with rotation of the rough crush blades 4.

On sliding surfaces of the rocking side walls 103 against the fixed side walls 102, which are substantially vertically below the rotating shaft 60, shaft bodies 121, 121 (first rocking shafts) are disposed perpendicularly, parallel to the axial direction of the rotating shaft 60. Shaft bodies 122, 122 (second rocking shafts) are disposed perpendicularly on sliding surfaces of the fixed side walls 102 against the rocking side walls 103, parallel to the axial direction of the shaft bodies 121 so as to be on a nearly-level with the respective shaft bodies 121 and closer to the outside than the shaft bodies 121.

At a sliding surface of each fixed side wall 102 against a rocking side wall 103, a minor-arc race 125 for guiding a shaft body 121, which rocks around a shaft body 122 in accordance with the rocking motion of the rocking side wall 103, is formed. A semi-arc fitting surface 132 to be fitted with a shaft body 122 is formed above the shaft body 122 of each rocking side wall 103.

Figure 7:
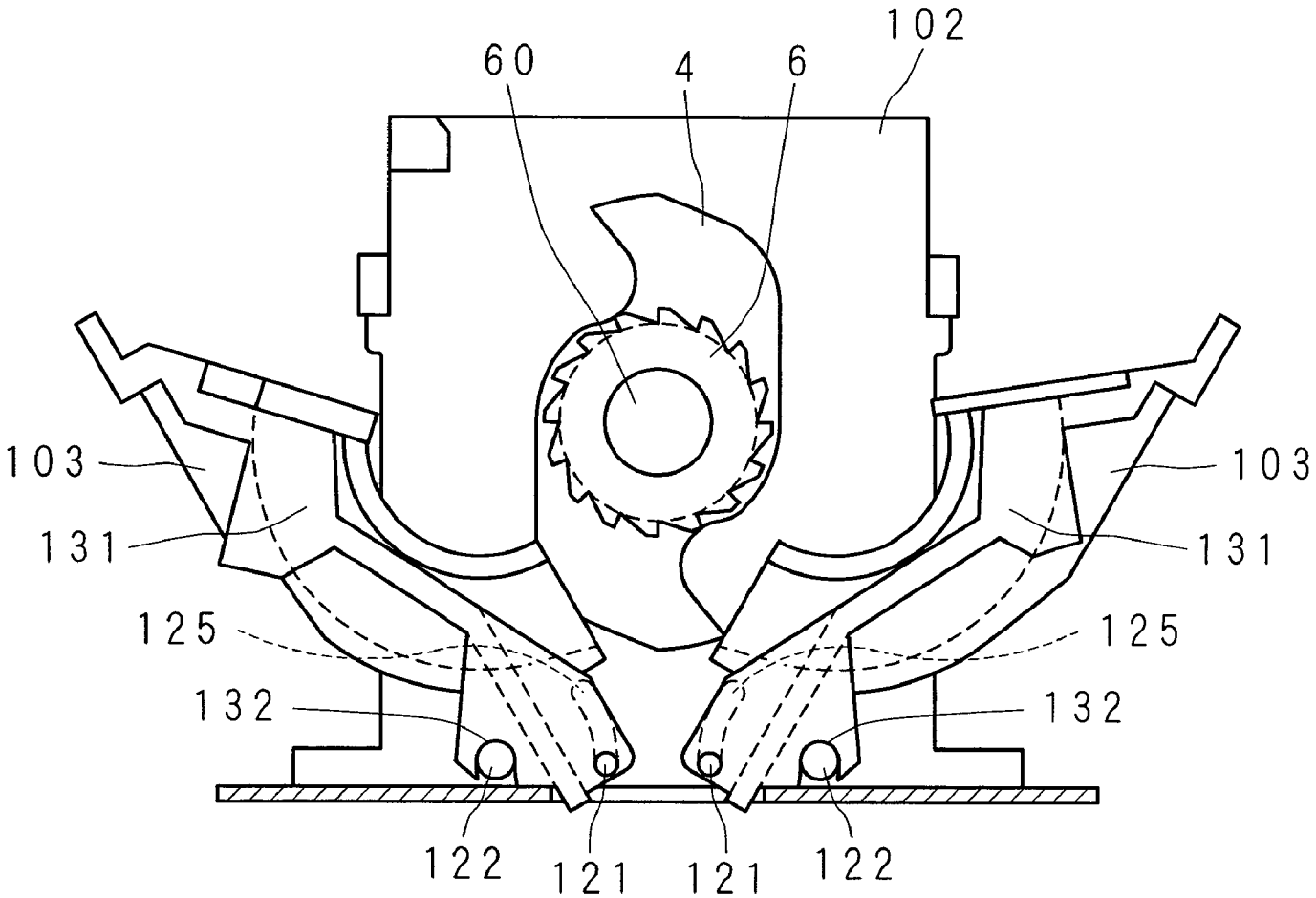
FIG. 7 is a schematic side view for illustrating an essential part of a crusher in the opening and closing motion of a rocking side wall
Figure 8:
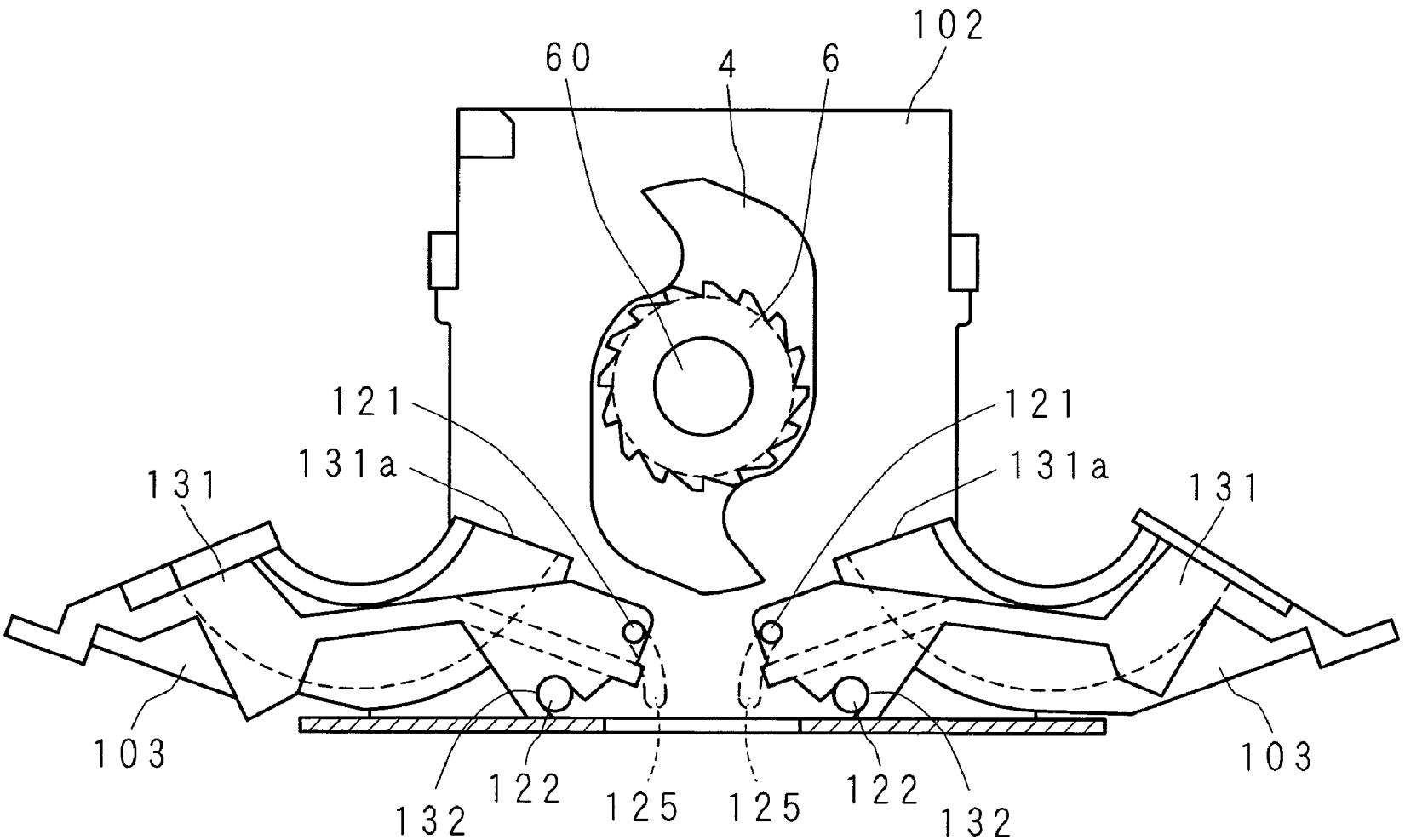
FIG. 8 is a schematic side view for illustrating an essential part of a crusher in the opening and closing motion of a rocking side wall

Next, a state of the rocking side walls 103 in the opening and closing motion will be explained. FIGS. 7 and 8 are schematic side views for illustrating an essential part of a crusher in the opening and closing motion of the rocking side walls 103. As illustrated in FIG. 7, at an early stage of the opening motion of the rocking side walls 103, the rocking side walls 103 are rotated about the shaft bodies 121 until the fitting surfaces 132 formed at the rocking side walls 103 are fitted with the shaft bodies 122.

Also in such a case, since the rotation center of each rocking side wall 103 is a shaft body 121 placed substantially vertically below the rotating shaft 60 as in Embodiment 1, an end part or an edge part of a rough crush blade cover 131 provided at the inner side of the rocking side wall 103, which is a part adjacent to a rough crush blade 4 or a crush blade 6, moves in an arc around the shaft body 121. With such a structure wherein the end part or the edge part of each rough crush blade cover 131 moves away from the rough crush blade 4 or the crush blade 6 with rotation of the rocking side wall 103, the rocking side wall 103 can be opened without an interference of the inner part (especially the rough crush blade cover 131) of the rocking side wall 103 with the rough crush blade 4 or the crush blade 6.

As illustrated in FIG. 8, when the rocking side walls 103 are further opened in a state where the fitting surfaces 132 formed at the rocking side walls 103 are fitted with the shaft bodies 122, the rocking side walls 103 are rotated about the shaft bodies 122. That is, the rocking shaft of each rocking side wall 103 moves from a shaft body 121 to a shaft body 122 in the middle of the opening motion of the rocking side wall 103. When the rocking side walls 103 are rotated about the shaft bodies 122 placed closer to the outside than the shaft bodies 121, the rocking side walls 103 are opened while being further away from the rough crush blades 4 and the crush blades 6, and this can widen the opening between the rocking side walls 103.

As illustrated in FIG. 8, the size of an opening between the rocking side walls 103 is set further greater in a state where the rocking side walls 103 are opened. Especially, since end surfaces 131*a* of the rough crush blade covers 131 are located away from the rough crush blades 4 and the crush blades 6 so as to be closer to the outside, it is unnecessary to form a rough crush blade cover to be detachable as in a conventional crusher, and an opening between the rocking side walls 103 can be widened with a simple structure. This facilitates cleaning of crush debris, reduces cleaning time and prevents crush debris from remaining in the crusher.

Embodiment 3

Though Embodiment 2 has a structure wherein races are formed at the fixed side wall side, the present invention is not limited to this and races can be formed at the rocking side wall side.

Figure 9:
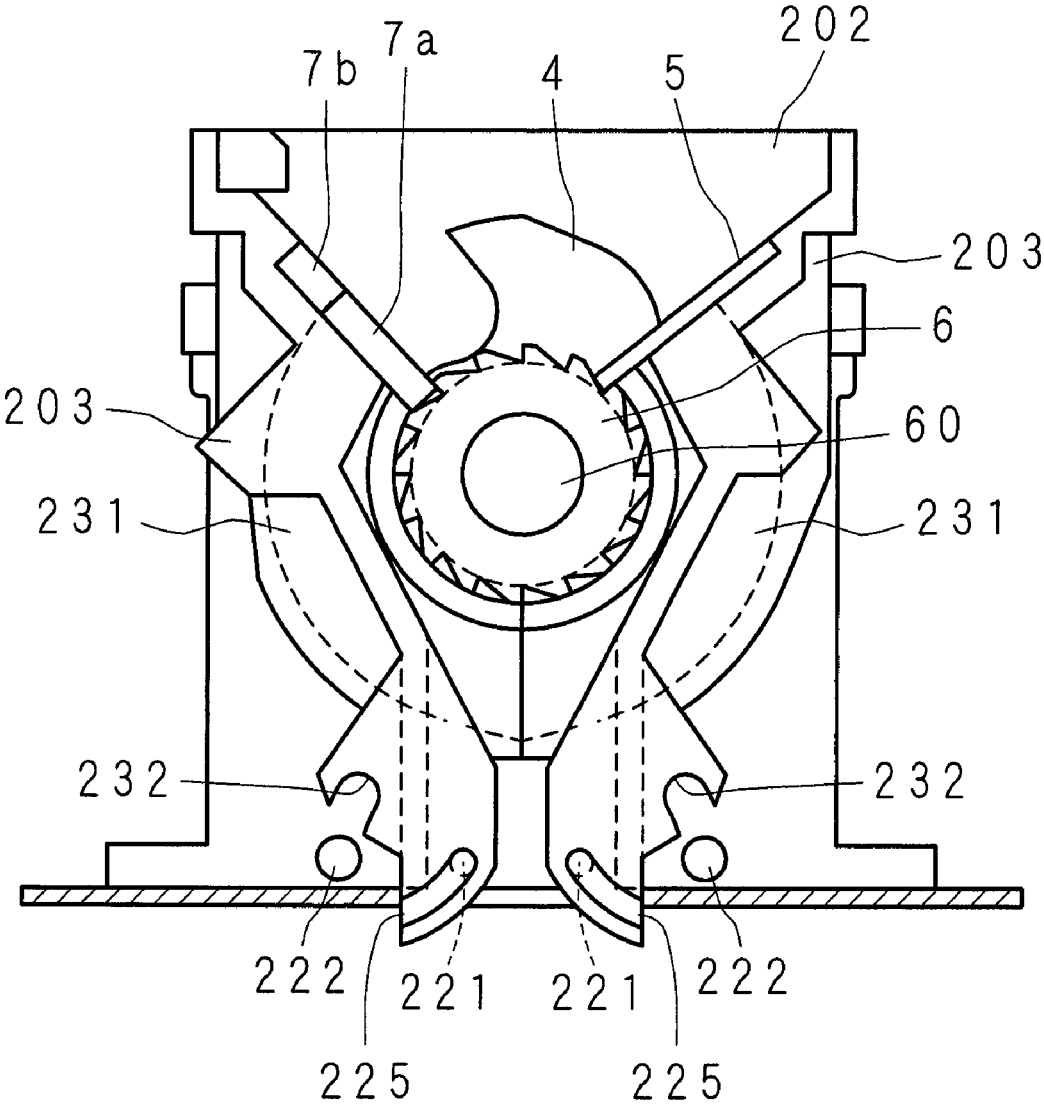
FIG. 9 is a schematic side view for illustrating an essential part of a crusher according to Embodiment 3

FIG. 9 is a schematic side view for illustrating an essential part of a crusher according to Embodiment 3. It is to be noted that a state where rocking side walls 203, 203 are closed is illustrated in FIG. 9. As illustrated in the figure, a rotating shaft 60 is laid between substantially central parts of fixed side walls 202, and rough crush blades 4 and crush blades 6 are fitted with the rotating shaft 60 at predetermined positions. At an upper part of the inner surface of one rocking side wall 203, a fixed blade 7 (first fixed blades 7*a* and a second fixed blade 7*b*) is fixed so as to slant in a downward direction toward the rotating shaft 60, and a rough crush blade cover 231 is provided at the rotation orbit of the rough crush blades 4 below the fixed blade 7.

At an upper part of the inner surface of the other rocking side wall 203, a scraper 5 is fixed so as to slant in a downward direction toward the rotating shaft 60, and a rough crush blade cover 231 is provided at the rotation orbit of the rough crush blades 4 below the scraper 5.

The respective rough crush blade covers 231 have a minor-arc annular shape having a predetermined thickness, and grooving is applied to the inner side thereof along the rotation orbit of the rough crush blades 4. In a state where the rocking side walls 203, 203 are closed, an end part of one of the rough crush blade cover 231 comes into contact with that of the other rough crush blade cover 231 and receive untreated crush debris which has come under the fixed blade 7 and the scraper 5 with rotation of the rough crush blades 4.

On sliding surfaces of the fixed side walls 202 against the rocking side walls 203, which are substantially vertically below the rotating shaft 60, shaft bodies 221, 221 (first rocking shafts) are disposed perpendicularly, parallel to the axial direction of the rotating shaft 60. Shaft bodies 222, 222 (second rocking shafts) are disposed perpendicularly on sliding surfaces of the fixed side walls 202 against the rocking side walls 203, parallel to the axial direction of the shaft bodies 221 so as to be on a nearly-level with the respective shaft bodies 221 and closer to the outside than the shaft bodies 221.

At a sliding surface of each rocking side wall 203 against a fixed side wall 202, a minor-arc race 225 for guiding a shaft body 221 in accordance with the rocking motion of the rocking side wall 203 is formed. A semi-arc fitting surface 232 to be fitted with a shaft body 222 is formed above the shaft body 222 of each rocking side wall 203.

Figure 10:
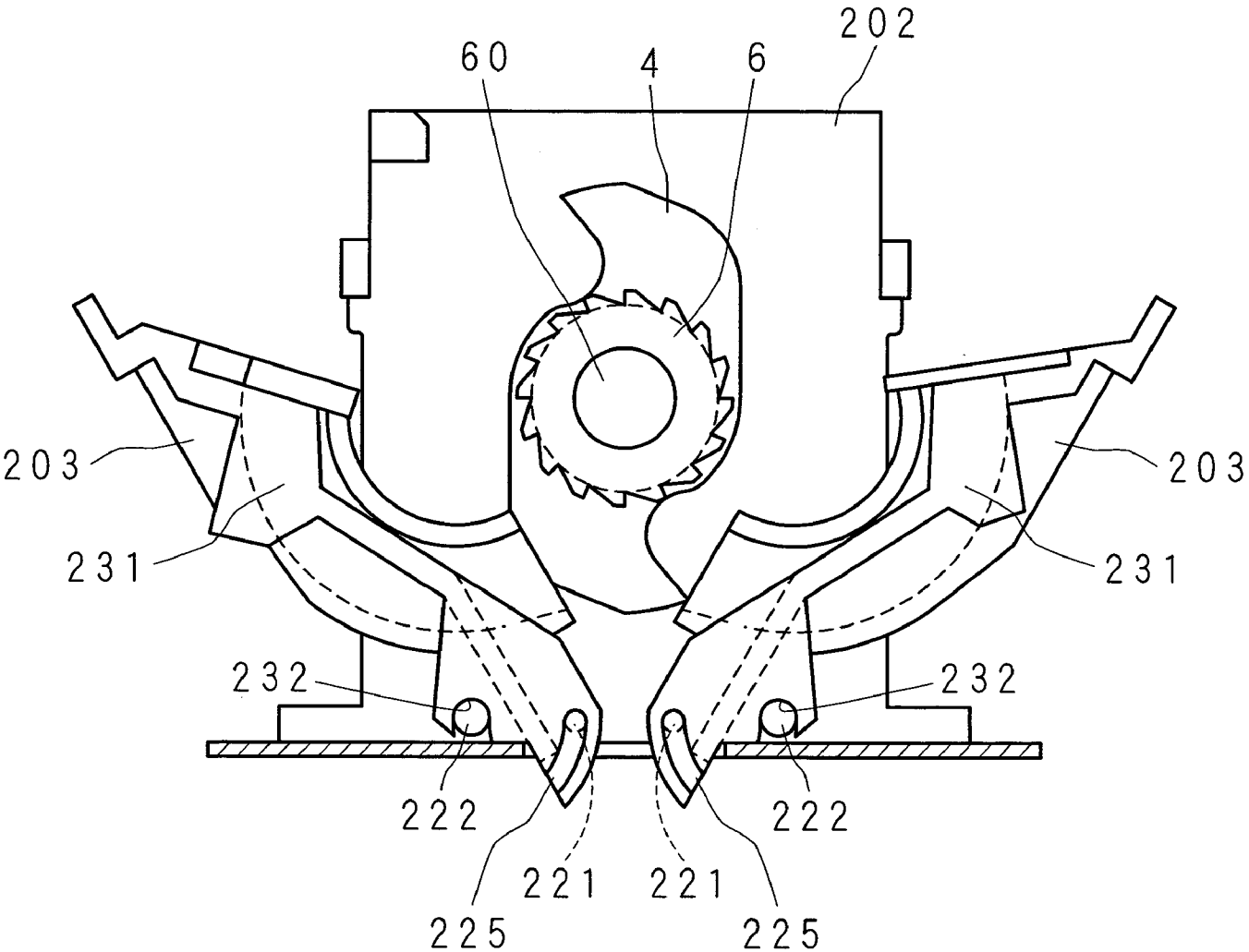
FIG. 10 is a schematic side view for illustrating an essential part of a crusher in the opening and closing motion of a rocking side wall
Figure 11:
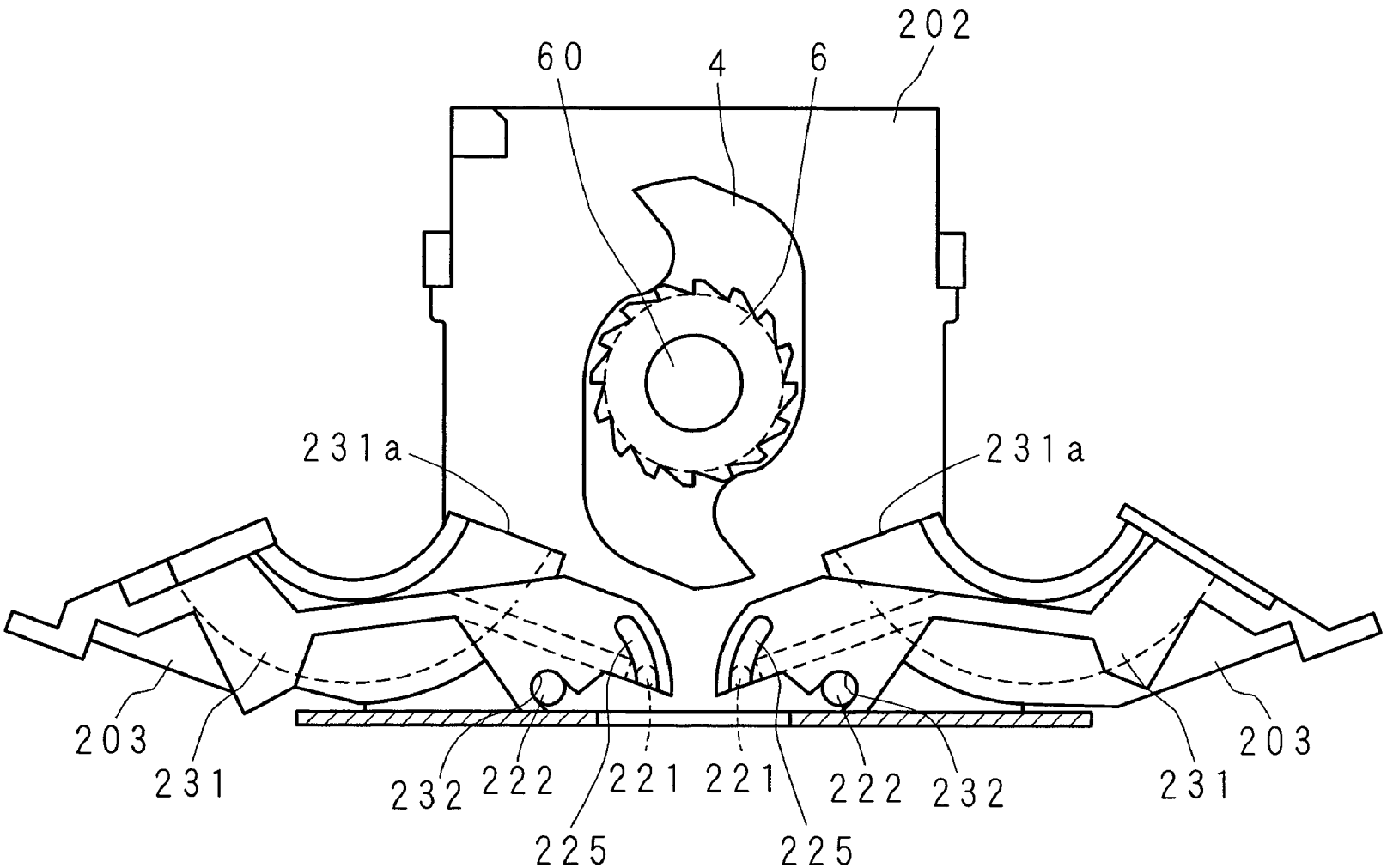
FIG. 11 is a schematic side view for illustrating an essential part of a crusher in the opening and closing motion of a rocking side wall
Figure 12:
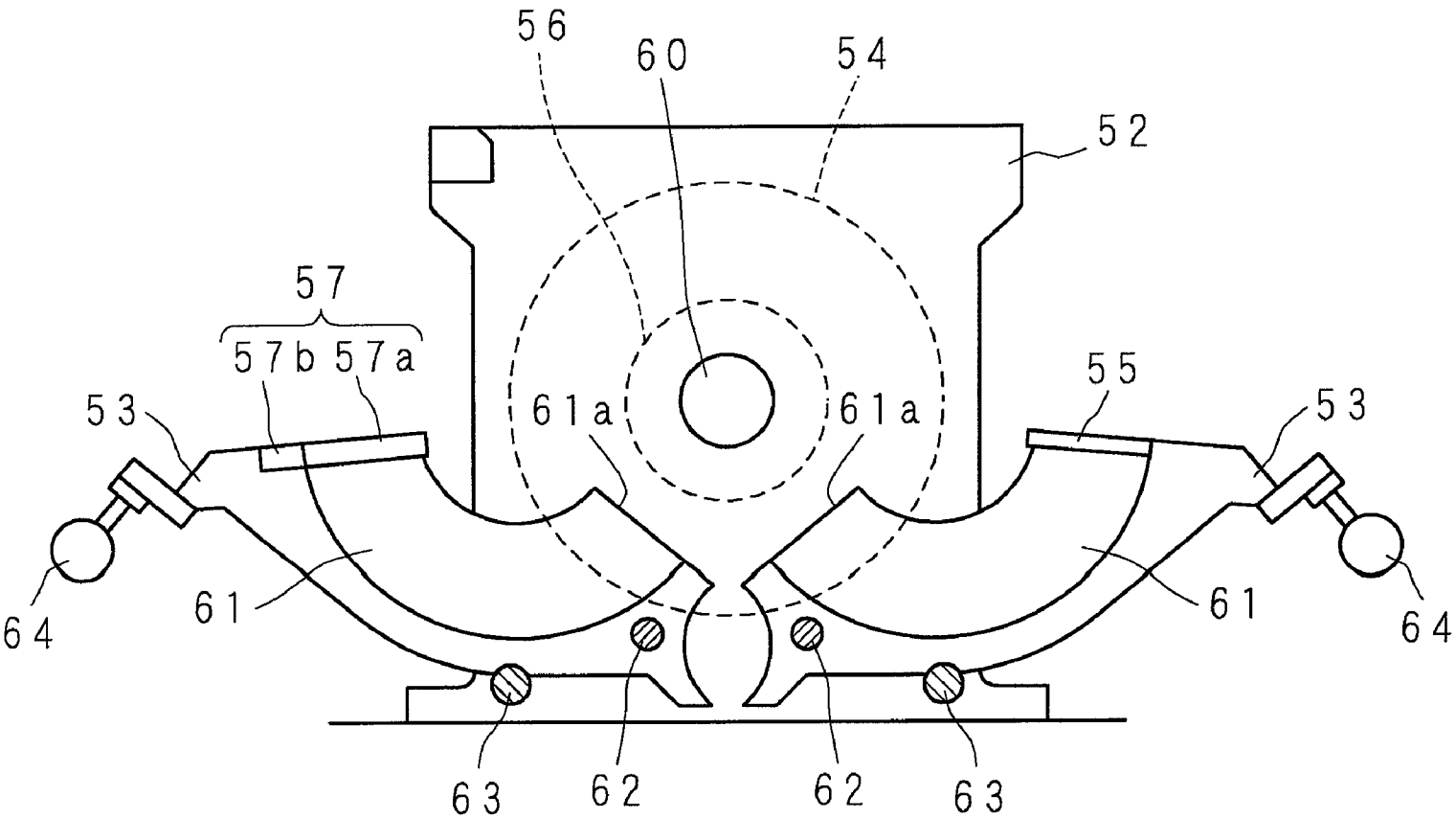
FIG. 12 RELATED ART
FIG. 12 is a schematic side view for illustrating an essential part of a conventional crusher

Next, the postures of the rocking side walls 203 in the opening and closing motion will be explained. FIGS. 10 and 11 are schematic side views for illustrating an essential part of a crusher in the opening and closing motion of the rocking side walls 203. As illustrated in FIG. 10, at an early stage of the opening motion of the rocking side walls 203, the rocking side walls 203 are rotated about the shaft bodies 221 until the fitting surfaces 232 formed at the rocking side walls 203 are fitted with the shaft bodies 222.

Also in such a case, since the rotation center of each rocking side wall 203 is a shaft body 221 placed substantially vertically below the rotating shaft 60 as in Embodiment 2, an end part or an edge part of a rough crush blade cover 231 provided at the inner side of the rocking side wall 203, which is a part adjacent to a rough crush blade 4 or a crush blade 6, moves in an arc around the shaft body 221. With such a structure wherein the end part or the edge part of each rough crush blade cover 231 moves away from the rough crush blade 4 or the crush blade 6 with rotation of the rocking side wall 203, the rocking side wall 203 can be opened without an interference of the inner part (especially the rough crush blade cover 231) of the rocking side wall 203 with the rough crush blade 4 or the crush blade 6.

As illustrated in FIG. 11, when the rocking side walls 203 are further opened in a state where the fitting surfaces 232 formed at the rocking side walls 203 are fitted with the shaft bodies 222, the rocking side walls 203 are rotated about the shaft bodies 222. That is, the rocking shaft of each rocking side wall 203 moves from a shaft body 221 to a shaft body 222 in the middle of the opening motion of the rocking side wall 203. When the rocking side walls 203 are rotated about the shaft bodies 222 placed closer to the outside than the shaft bodies 221, the rocking side walls 203 are opened while being further away from the rough crush blades 4 and the crush blades 6, and this can widen the opening between the rocking side walls 203.

As illustrated in FIG. 11, the size of an opening between the rocking side walls 203 is set further greater in a state where the rocking side walls 203 are opened. Especially, since end surfaces 231*a* of the rough crush blade covers 231 are located away from the rough crush blades 4 and the crush blades 6 so as to be closer to the outside, it is unnecessary to form a rough crush blade cover to be detachable as in a conventional crusher, and an opening between the rocking side walls 203 can be widened with a simple structure. This facilitates cleaning of crush debris, reduces cleaning time and prevents crush debris from remaining in the crusher.

As explained above, in the present invention, an interference between a rocking side wall and rotating blades (a rough crush blade or a crush blade) is prevented and the size of an opening at the lower part of the rocking side wall is set further greater to facilitate cleaning of crush debris, reducing cleaning time and preventing crush debris from remaining in the crusher. Moreover, a rocking side wall can be opened and closed by only a rotating operation so as to, for example, solve a number of problems caused when a rocking side wall is slid for parallel translation, and the opening and closing motion of the rocking side wall can be facilitated. Moreover, it is unnecessary to form a part of a rough crush blade cover to be detachable, and an opening between the rocking side walls can be widened with a simple structure. Furthermore, deviation of the rocking side wall in the vertical direction in the closing motion of the rocking side wall is prevented and damage to a blade edge of a fixed blade and a rotating blade in the opening and closing motion can be prevented.

The positions and arrangement of the shaft bodies (first rocking shafts and second rocking shafts) in the embodiments described above are only an example and the present invention is not limited to them, and the positions or arrangement can be decided arbitrarily in accordance with a difference in the output of a crusher, the shape of a rocking side wall or a fixed side wall, or the like.

Though the embodiments described above have a structure wherein fixing pins are disposed perpendicularly on the fixed side walls and fitting surfaces are formed at the rocking side walls in order to prevent deviation of the rocking side walls in the vertical direction, the present invention is not limited to this and a structure wherein fixing pins are disposed perpendicularly on the rocking side walls and fitting surfaces are formed at the fixed side walls may be employed. Moreover, the shapes and the dimensions of the fixing pins and the fitting surfaces are only an example and the present invention is not limited to them, and any structure may be employed as long as deviation of the rocking side walls in the vertical direction can be prevented in a state where the rocking side walls are closed.

The present invention is not limited to the embodiments.

The invention claimed is:

1. A crusher comprising:

a pair of rocking side walls that can be rocked to open and close and have an upward opening;

a rotating shaft having a rotating blade at a space enclosed by both rocking side walls for crushing an object with a fixed blade provided at an inner side of one of the rocking side wall and the rotating blade in cooperation with each other;

a first rocking shaft, which is placed below the rotating shaft and is parallel to the rotating shaft, for rocking each rocking side wall;

a second rocking shaft, which is placed outside of the first rocking shaft and is parallel to the first rocking shaft, for rocking each rocking side wall;

a rocking axis of the rocking side walls is made to move from the first rocking shaft to the second rocking shaft when the rocking side walls are to be opened; and a rocking axis of the rocking side walls is made to move from the second rocking shaft to the first rocking shaft when the rocking side walls are closed.

2. The crusher according to claim 1, wherein the first rocking shaft is constructed to rock around the second rocking shaft when the rocking side walls are to be opened and closed.

3. The crusher according to claim 2, further comprising:

a pair of fixed side walls are arranged at both end parts of the rotating shaft with both rocking side walls sandwiched therebetween;

the first rocking shaft is provided at each rocking side wall, and the second rocking shaft is provided at each fixed side wall;

a connection member for connecting the first rocking shaft with the second rocking shaft;

the rocking side walls have a lock part to be locked at the connection member in the middle of rotation about the first rocking shaft when the rocking side walls are to be opened; and the rocking side walls are constructed to rotate about the second rocking shaft in operative association with the connection member when the lock part is locked at the connection member.

4. The crusher according to claim 3, further comprising:

the rocking side walls are provided with a first fitting member for positioning of the rocking side walls in a vertical direction with both rocking side walls closed; and the fixed side walls are provided with a second fitting member to be fitted with the first fitting member.

5. The crusher according to claim 1, further comprising:

a pair of fixed side walls having sliding surfaces against the rocking side walls are arranged at both end parts of the rotating shaft with both rocking side walls sandwiched therebetween;

the first rocking shaft is disposed perpendicularly on a sliding surface of the rocking side walls against each fixed side wall; and a minor-arc race for guiding the first rocking shaft, which rocks around the second rocking shaft in accordance with a rocking motion of the rocking side walls, is provided at a sliding surface of the fixed side walls against the rocking side walls.

6. The crusher according to claim 5, further comprising:

the rocking side walls are provided with a first fitting member for positioning of the rocking side walls in a vertical direction with both rocking side walls closed; and the fixed side walls are provided with a second fitting member to be fitted with the first fitting member.

7. The crusher according to claim 1, further comprising:

a pair of fixed side walls having sliding surfaces against the rocking side walls are arranged at both end parts of the rotating shaft with both rocking side walls sandwiched therebetween;

the first rocking shaft is disposed perpendicularly on a sliding surface of the fixed side walls against each rocking side wall; and a minor-arc race for guiding the first rocking shaft in accordance with a rocking motion of the rocking side walls is provided at a sliding surface of the rocking side walls against the fixed side walls.

8. The crusher according to claim 7, further comprising:

the rocking side walls are provided with a first fitting member for positioning of the rocking side walls in a vertical direction with both rocking side walls closed; and the fixed side walls are provided with a second fitting member to be fitted with the first fitting member.

* * * * *